US005546626A

United States Patent [19]

Chung

[11] Patent Number: 5,546,626

[45] Date of Patent: Aug. 20, 1996

[54] TOOTHBRUSH WITH MOVABLE BUNDLES OF BRISTLES

[76] Inventor: Chin-Fu Chung, No. 898, Min-sheng St., Kuei-Jen Hsiang, Tainan Hsien, Taiwan

[21] Appl. No.: 575,633

[22] Filed: Dec. 20, 1995

[51] Int. Cl.[6] ..... A46B 9/08

[52] U.S. Cl. ..... 15/167.1; 15/201

[58] Field of Search ..... 15/201, 167.1, 15/191.1, 198, 22.1, 22.2

[56] References Cited

U.S. PATENT DOCUMENTS

| | | | |
|---|---|---|---|
| 1,415,760 | 5/1922 | Alles | 15/22.1 |
| 3,386,118 | 6/1968 | Morioku et al. | 15/201 |
| 4,783,869 | 11/1988 | Lee | 15/22.1 |
| 5,068,939 | 12/1991 | Holland | 15/28 |
| 5,070,567 | 12/1991 | Holland | 15/28 |
| 5,138,734 | 8/1992 | Chung | 15/167.1 |
| 5,184,368 | 2/1993 | Holland | 15/201 |

FOREIGN PATENT DOCUMENTS

| | | | |
|---|---|---|---|
| 0504893 | 9/1992 | European Pat. Off. | 15/201 |

*Primary Examiner*—David Scherbel
*Assistant Examiner*—James F. Hook
*Attorney, Agent, or Firm*—Varndell Legal Group

[57] ABSTRACT

A toothbrush wherein a plurality of tubular bristle holders are sleeved onto respective upright pins inside the head of the toothbrush and supported on a respective spring to hold a respective bundles of bristles outside a respective hole at the top of the head of the toothbrush so that each tubular bristle holder is rotated downwards along a spiral groove around the respective upright pin when the respective bundle of bristles is depressed by the teeth, or rotated upwards when the respective bundle of bristles is released from the teeth.

1 Claim, 8 Drawing Sheets

TOOTHBRUSH WITH MOVABLE BUNDLES OF BRISTLES

BACKGROUND OF THE INVENTION

The present invention relates to toothbrushes, and relates more particularly to such a toothbrush which comprises movable bundles of bristles that can be rotated upwards and downwards when they are rubbed against the teeth.

In regular toothbrushes, the bristles are fixedly fastened into the head of the handle. This structure of toothbrush cannot effectively remove food bits from the teeth. Because the bristles are not movable with the curvature of the periphery of the teeth and the pitch between each two teeth, they cannot be inserted into the gaps in teeth without hurting the gum. In order to force the bristles into the gaps in the, teeth, much effort shall be applied, and therefore the gum tends to be damaged by the bristles which are not inserted into the gaps in the teeth. Brushing the teeth with much effort will damage the enamel of the teeth, and will cause the bristles to deform quickly. Therefore, the service life of regular toothbrushes is short. If to brush the teeth with a toothbrush of which the bristles are deformed, the teeth cannot be well cleaned. There are also known various motor-driven toothbrushes available on the market. These motor-driven toothbrushes can clean the teeth effectively, however the high revolving speed of the bundles of bristles tend to damage the gum. Furthermore, these motor-driven toothbrushes are expensive.

SUMMARY OF THE INVENTION

It is one object of the present invention to provide a toothbrush which permits the bundles of bristles to be rotated upwards and downwards without consuming power supply. It is another object of the present invention to provide a toothbrush which does not damage the gum and the enamel of the teeth during brushing. It is another object of the present invention to provide a toothbrush which is comfortable and durable in use. It is still another object of the present invention to provide a toothbrush which can effectively remove food bits from the gaps in the teeth.

According to the preferred embodiment of the present invention, the head of the toothbrush comprises a box-like casing having rows of upright pins on the inside, each upright pin having a spiral groove around the periphery; a cover covered on the box-like casing having rows of through holes respectively disposed in alignment with the rows of upright pins of the box-like easing; a plurality of tubular bristle holders respectively sleeved onto the upright pins and stopped inside the box-like casing by the cover, each tubular bristle holder holds a bundle of bristles outside one through hole of the cover, and has two steel balls retained at two opposite sides by two plugs and partially forced into the spiral groove of the respective upright pin; and a plurality of spring elements respectively mounted around the upright pins and stopped between the box-like casing and the tubular bristle holders to force the tubular bristle holders upwards. Therefore, the bundles of bristles are rotated downwards and upwards to clean the teeth during brushing.

DETAILED DESCRIPTION OF THE PREFERRED EMBODIMENT

Figure 1:
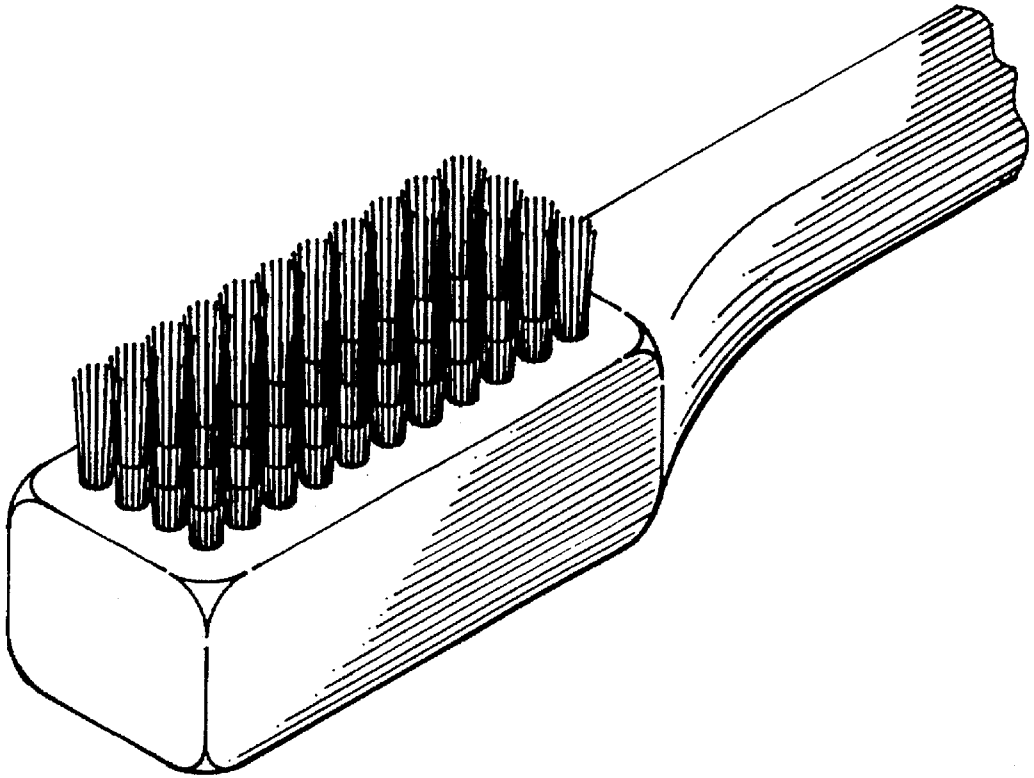
PRIOR ART Fig. 1
FIG. 1 shows a regular toothbrush.
Figure 2:
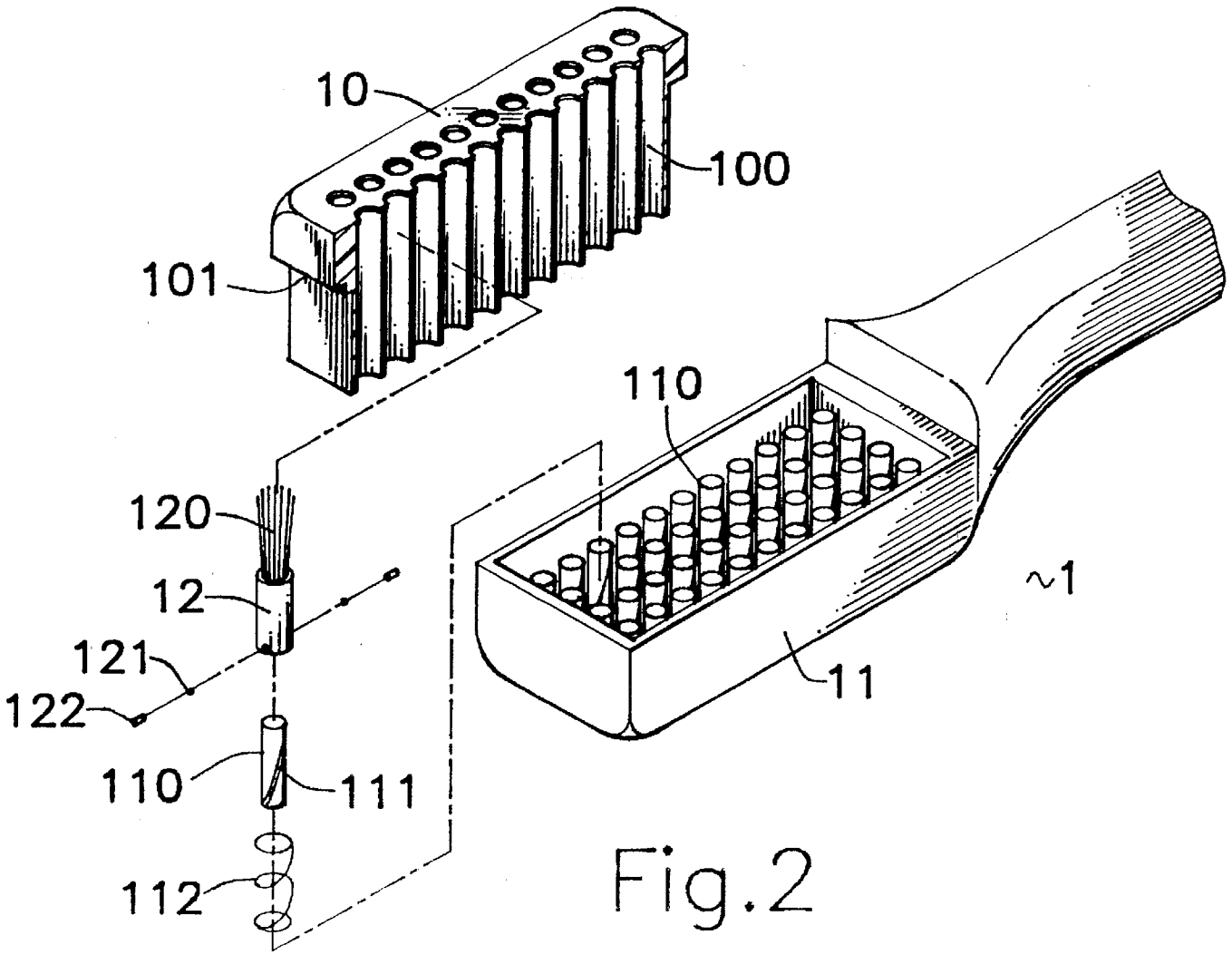
FIG. 2 is an exploded view of a toothbrush according to the present invention.
Figure 3:
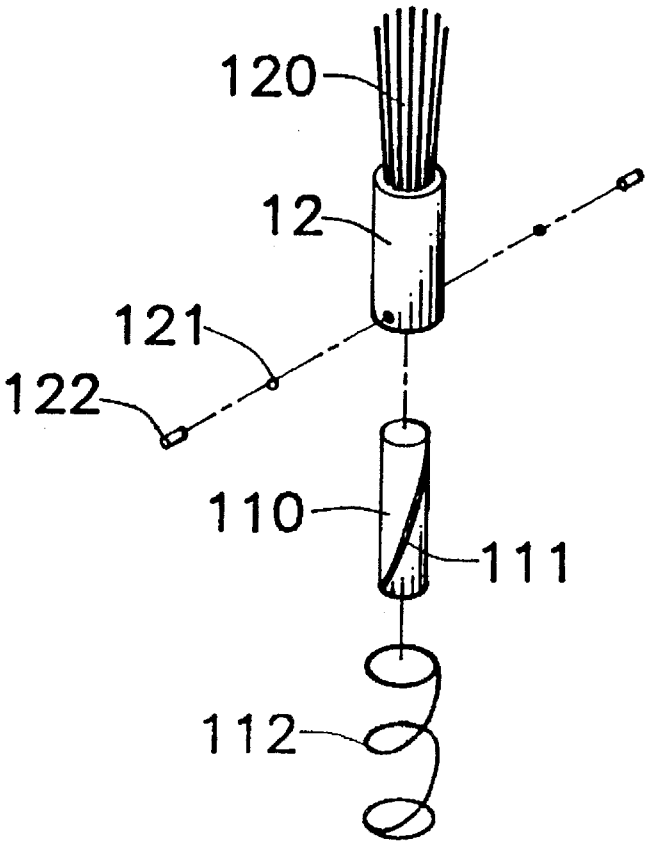
FIG. 3 is an exploded view of a tubular bristle holder, an upright pin, and a spring according to the present invention.
Figure 4:
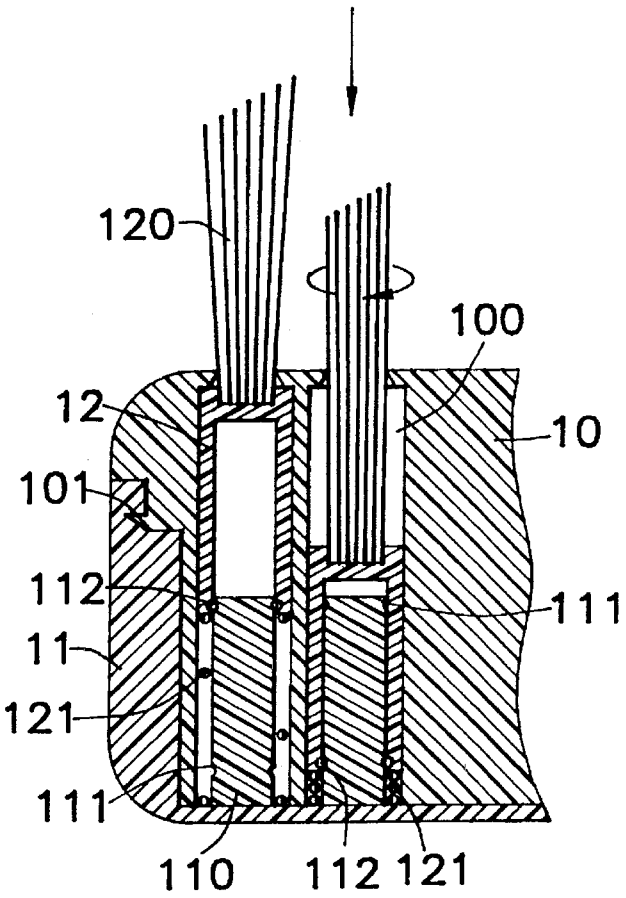
FIG. 4 is a sectional view in an enlarged scale of the front part of the head of the toothbrush according to the present invention.

Referring to FIGS. 2, 3, and 4, the head 1 at one end of the handle of a toothbrush in accordance with the present invention comprises a box-like casing 11, a cover 10 covered on the box-like casing 11, and a plurality of tubular bristle holders 12. The cover 10 fits the box-like casing 11, having a front hook 101 hooked on the inside wall of the box-like casing 11, and rows of vertical through holes 100. A plurality of upright pins 110 are fixedly mounted within the box-like casing 11 corresponding to the vertical through holes 100 of the cover 10. Each of the upright pins 110 has a spiral groove 111 around the periphery. The tubular bristle holders 12 are respectively sleeved onto the upright pins 110 and supported on a respective spring 112 and held inside the box-like casing 11 by the cover 10 to hold a respective bundle of bristles 120 outside each vertical through hole 100 of the cover 10. Each of the tubular bristle holders 12 has two steel balls 121 retained at two opposite sides by two plugs 122 and partially forced into the spiral groove 111 of the respective upright pin 110. Therefore, each tubular bristle holder 12 can be rotated upwards and downwards along the spiral groove 111 of the respective upright pin 110.

Figure 6:
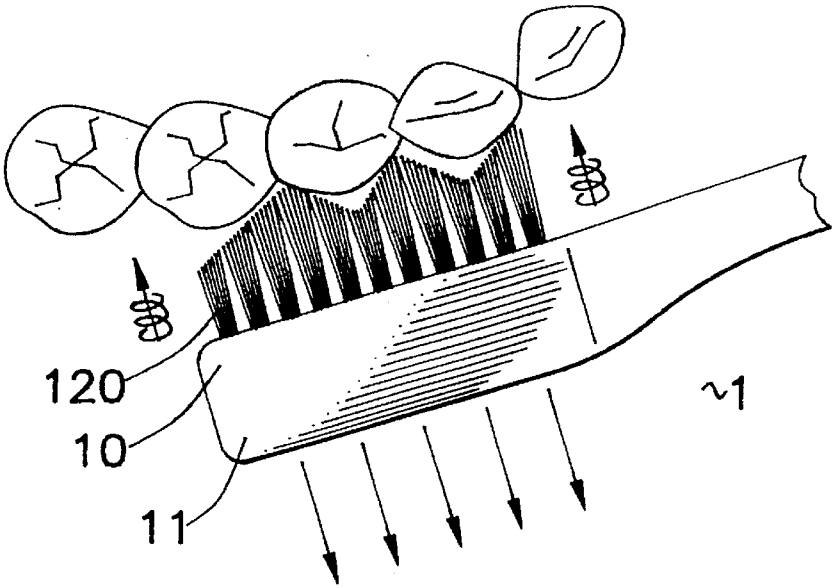
FIG. 6 is another applied view of the present invention, showing the bristles released from the teeth.
Figure 5:
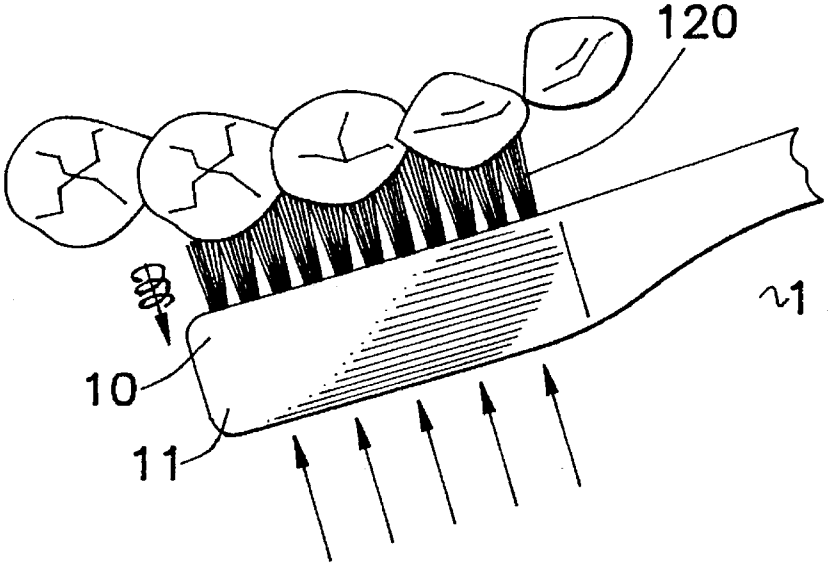
FIG. 5 is an applied view of the present invention showing the bristles depressed by the teeth.
Figure 7:
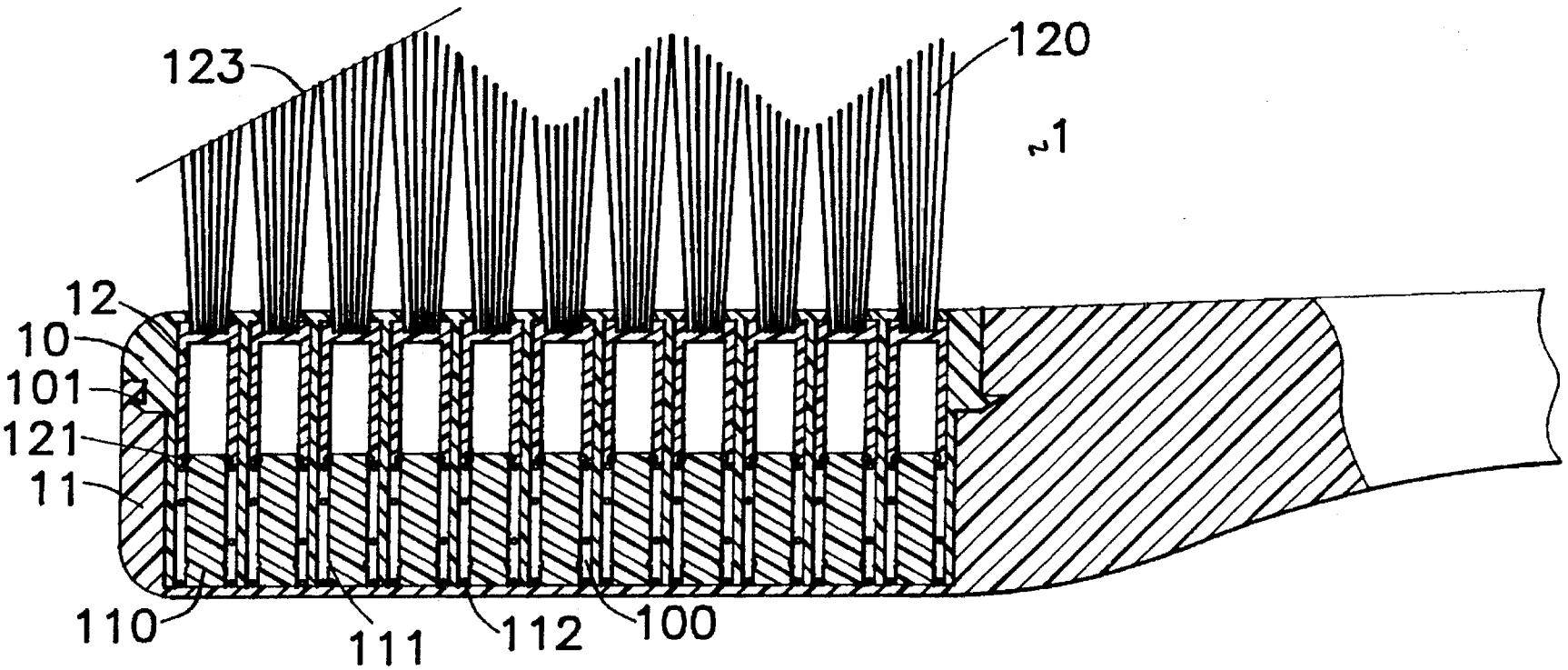
FIG. 7 is a side view in section in an enlarged scale of the head of the toothbrush according to the present invention.
Figure 8:
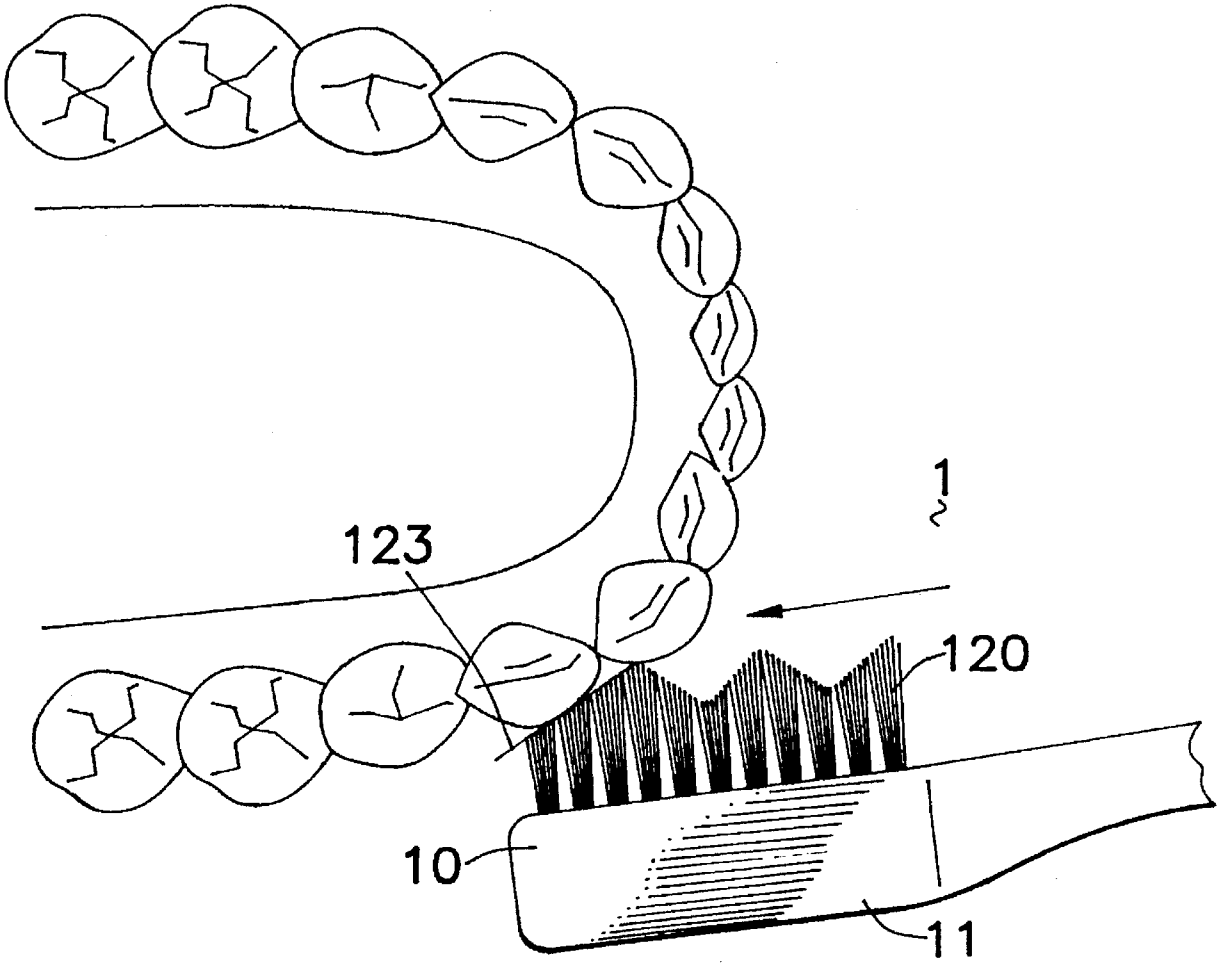
FIG. 8 shows the guide slope of the bristles moved over the teeth according to the present invention.

When the head 1 of the toothbrush is moved against the teeth, the bristles 120 are rotated downwards to pick up food bits from the teeth (see FIG. 5); when the head 1 of the toothbrush is released from the teeth, the bristles 120 are rotated upwards in the reversed direction to remove food bits from the teeth (see FIG. 6). Furthermore, the bristles 120 of each tubular bristle holder 12 are of different heights, so that the bristles 120 form a guide slope 123 (see FIG. 7), which does not hurt the gum when it is forced against the teeth (see FIG. 8).

Figure 9:
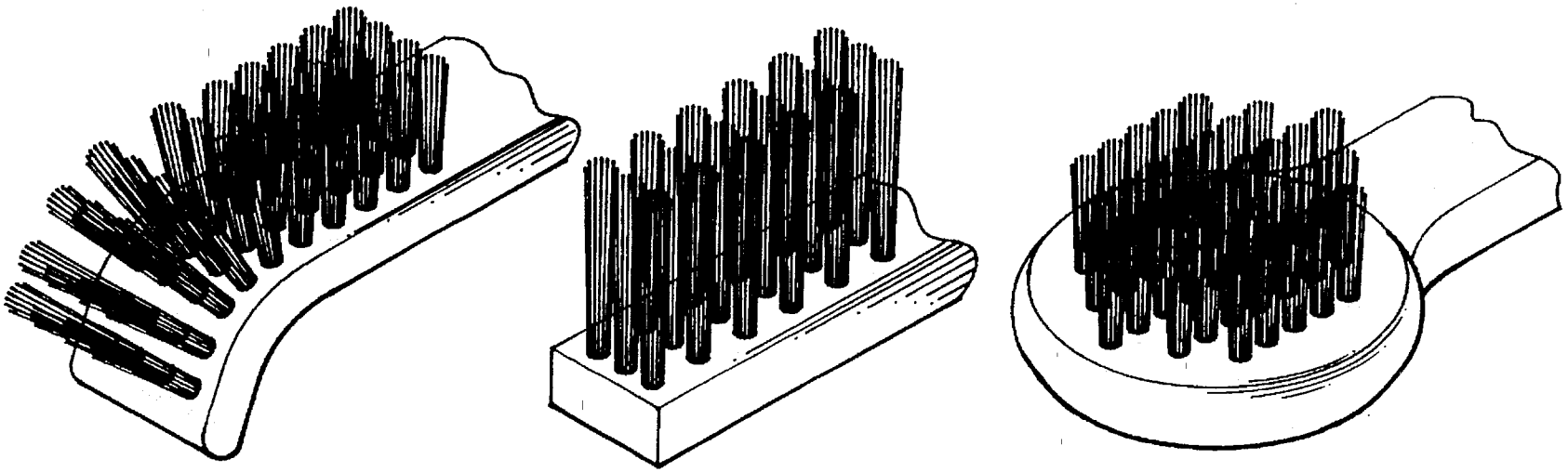
FIG. 9 shows different forms of brushes according to the present invention.

Furthermore, the aforesaid structure can be employed to the fabrication of any of a variety of brushes as shown in FIG. 9.

I claim:

1. A toothbrush of the type comprising a handle, and a head at one end of said handle to hold bundles of bristles, wherein said head comprises:

a box-like easing having rows of upright pins on the inside, each upright pin having a spiral groove around the periphery;

a cover covered on said box-like casing, having rows of through holes respectively disposed in alignment with the rows of upright pins of said box-like casing;

a plurality of tubular bristle holders respectively sleeved onto said upright, pins and stopped inside said box-like casing by said cover, each tubular bristle holder holding a bundle of bristles outside one through hole of said cover, and has two steel balls retained at two opposite sides by two plugs and partially forced into the spiral groove of the respective upright pin; and a plurality of spring elements respectively mounted around said upright pins and stopped between said box-like casing and said tubular bristle holders to force said tubular bristle holders upwards.

* * * * *